United States Patent [19]

Brimhall et al.

[11] Patent Number: 4,804,355

[45] Date of Patent: Feb. 14, 1989

[54] APPARATUS AND METHOD FOR ULTRASOUND ENHANCEMENT OF SEDIMENTATION DURING CENTRIFUGATION

[75] Inventors: Owen D. Brimhall, West Valley City; Thomas J. McLaughlin; Stephen C. Peterson, both of Salt Lake City, all of Utah

[73] Assignee: Utah Bioresearch, Inc., Salt Lake City, Utah

[21] Appl. No.: 121,905

[22] Filed: Nov. 17, 1987

[51] Int. Cl.[4] ..... B04B 5/02

[52] U.S. Cl. ..... 494/20; 494/16; 494/37

[58] Field of Search ..... 494/16, 20, 37, 85; 366/127, 600

[56] References Cited

U.S. PATENT DOCUMENTS

| | | | |
|---|---|---|---|
| 2,407,462 | 9/1946 | Whiteley | 366/127 |
| 2,891,176 | 6/1959 | Branson | 366/127 |
| 3,692,236 | 9/1972 | Livshitz et al. | 494/37 |
| 3,720,368 | 3/1973 | Allen | 494/16 |
| 4,302,112 | 11/1981 | Steenstrup | 366/127 |

*Primary Examiner*—Timothy F. Simone
*Assistant Examiner*—J. Dwight Poffenberger, Jr.
*Attorney, Agent, or Firm*—J. Winslow Young

[57] ABSTRACT

This invention relates to the ultrasound enhancement of sedimentation of particulates in a particulate-bearing fluid medium while the fluid medium is undergoing centrifugation. The ultrasound energy forms standing waves in the fluid and cause particulates in the fluid, whether solids, liquids, or gases, to agglomerate in bands. The bands approximate either the nodes or antinodes of the standing wave, depending on the density of the particulate relative to the fluid. The banded or agglomerated particulate enhances the rate of sedimentation as well as the reverse flow of suspernatent by removing particulate which would otherwise impede this flow.

8 Claims, 2 Drawing Sheets

APPARATUS AND METHOD FOR ULTRASOUND ENHANCEMENT OF SEDIMENTATION DURING CENTRIFUGATION

BACKGROUND

1. Field of the Invention

This invention relates to an apparatus for sedimentation through centrifugation and, more particularly to an apparatus and method for creating at least one acoustic standing wave oriented generally orthogonal to the direction of the centrifugal force to provide enhanced sedimentation during centrifugation.

2. The Prior Art

Centrifugation apparatus are well known in a fluid material in the art and include devices for creating substantial centrifugal forces by rapidly spinning a quantity of the fluid material about an axis. The centrifugal force imposed upon particles or fractions in the fluid having different densities is proportional to the size and density of the particles as compared to the density of the fluid, the rate of rotation and the radial distance from the axis of rotation. These forces are stated in terms of gravity (G) so that a high speed centrifuge apparatus will create forces in the range of thousands of G's. However, even in the presence of such relatively strong centrifugal force fields certain particles require extensive periods of centrifugation to achieve the desired degree of separation.

One of the problems with centrifugation is that certain fluids may include a suspension of very fine particles having a density nearly identical to the fluid. The centrifugal forces created by the centrifuge apparatus act on these very slight density differences so that only a small fraction of the available centrifugal force is effective in moving the particle through the fluid.

Further, in order to move a particle through the fluid the particle must displace fluid in the opposite direction in order to achieve relative movement. Both of these factors are operative when a fluid such as blood is subjected to centrifugation. It has also been determined that agglomerated particles have a significantly greater rate of sedimentation under even a reduced centrifugal force.

It would, therefore, be a significant advancement in the art to provide an apparatus and method whereby particles in the fluid could be agglomerated so as to increase the rate of sedimentation during centrifugation. An even further advancement in the art would be to provide an apparatus and method for agglomerating particles in the fluid undergoing sedimentation, the agglomerated particles being formed in one or more bands generally orthogonal to the centrifugal forces so as to provide channels for the movement of displaced supernatant as the particles are sedimented. Such a novel apparatus and method is disclosed and claimed herein.

BRIEF SUMMARY AND OBJECTS OF THE INVENTION

This invention includes an apparatus and method for creating an acoustical, standing wave in a fluid undergoing centrifugation to cause agglomeration of particles in the fluid. The nodal planes of the wave are oriented generally orthogonal to the direction of the centrifugal force so as to provide a path for travel of supernatant fluid to be displaced upon movement of the agglomerated particles during sedimentation. The fluid is held in a vessel in which the acoustical wave is created by ultrasound energy coupled to the vessel while the fluid is subjected to the centrifugal force.

It is, therefore, a primary object of this invention to provide improvements in centrifuge apparatus.

Another object of this invention is to provide an apparatus for creating an acoustic wave in a fluid subjected to a centrifugal force to cause agglomeration of particles in the fluid.

Another object of this invention is to form acoustic standing waves in a fluid subjected to a centrifugal force, the nodal planes of the wave being oriented generally parallel to the direction of the centrifugal force.

Another object of this invention is to provide improvements in the method of sedimenting particles from a fluid undergoing centrifugation by agglomerating the particles with ultrasound to enhance sedimentation under centrifugal forces.

These and other objects and features of the present invention will become more readily apparent from the following description in which preferred and other embodiments of the invention have been set forth in conjunction with the accompanying drawing and appended claims.

DETAILED DESCRIPTION

Figure 1:
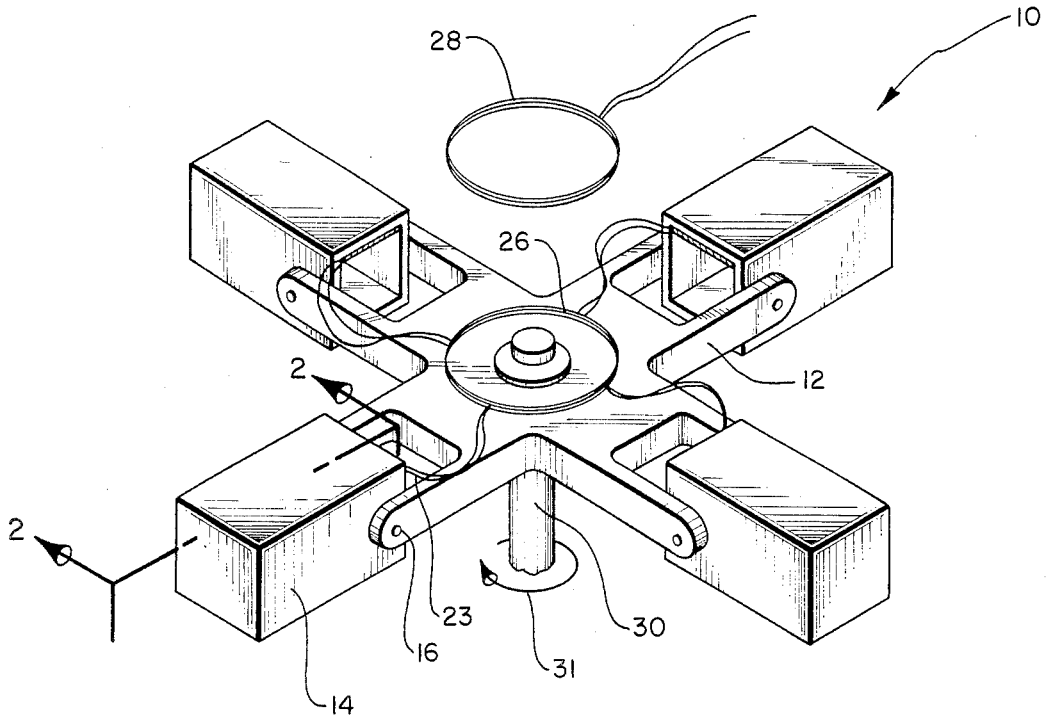
FIG. 1 is a partial, perspective view of the ultrasound enhanced centrifugation apparatus of this invention with portions illustrated schematically for ease of illustration.

The invention is best understood by reference to the drawing wherein like parts are designated by like numerals throughout in conjunction with the following description.

General Discussion

Sedimentation by centrifugation can be enhanced significantly by increasing the effective particle size through agglomeration and also by creating a path through which supernatant fluid can be displaced by movement of the sedimented particles. The present invention uses the acoustical wave created by ultrasound to provide a standing wave in the fluid. The standing wave is formed generally orthogonal to the centrifugal force. Particles in the fluid are agglomerated along the nodal planes or, as the case may be, the antinodal planes of the standing wave. The agglomerated particles have a larger effective particle size as a result of the agglomeration and, therefore, undergo a more rapid sedimentation under centrifugal force.

Since the total volume of fluid remains constant sedimentation of particles displaces supernatant fluid in the opposite direction. In the absence of open channels through the sedimenting particles the supernatant fluid is required to pass through the particles thus decreasing the rate of sedimentation to a significant degree. Accordingly, the creation of a standing wave in the fluid means that the particles will be agglomerated in bands, for example, nodal planes that are created by the standing wave. These bands or nodes are created generally parallel to the direction of the centrifugal force so that the respective nodal or antinodal portions of the standing wave form channels for the passage of the supernatant fluid displaced by the sedimenting particles. An example of agglomeration along the antinodal portions is when a dispersion of oil in water is processed according to the teachings of this invention so that the heavier water is separated along the nodes while the lighter oil is banded along the antinodal portions of the standing wave.

Figure 2:
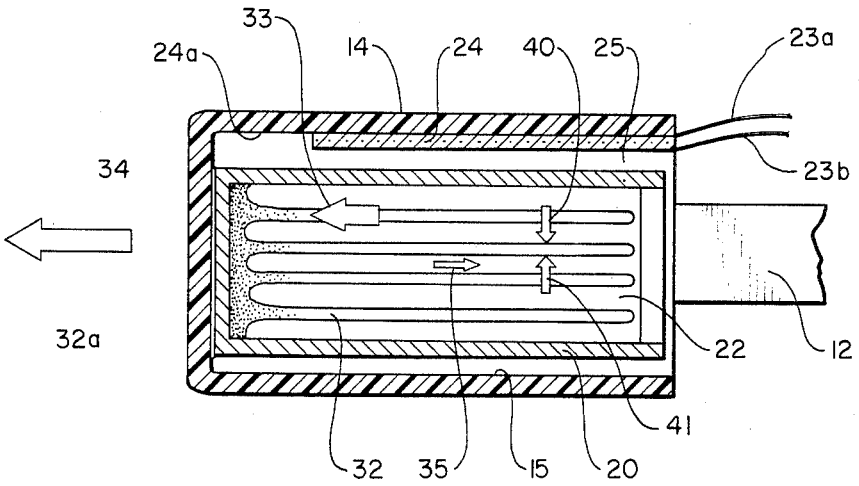
FIG. 2 is a cross sectional view taken along lines 2—2 of FIG. 1 with the fluid vessel being schematically illustrated as undergoing enhanced sedimentation during centrifugation.

Referring now to FIG. 1, the novel enhanced sedimentation apparatus of this invention is shown generally at 10 and includes a rotor arm 12 to which is pivotally suspended a chamber 14 at a pivot 16. Rotor arm 12 is mounted to an axle 30 which is turned by a motor (not shown) in the direction indicated schematically at arrow 31 and constitutes a standard part of a conventional centrifuge apparatus. A vessel 20 (FIG. 2) is mounted inside chamber 14 and serves as the container for a fluid 22 to undergo enhanced sedimentation. An ultrasound transducer 24 is mounted to chamber 14 and is acoustically coupled to fluid 22 through a coupling medium such as a coupling fluid 25 and vessel 20 so as to generate standing waves 40 and 41 in fluid 22.

Electrical energy for transducer 24 is supplied through an electrical lead 23 (leads 23*a* and 23*b*) from an RF pick-up coil 26 which is inductively coupled to an RF supply coil 28. The remainder of the circuitry for the electrical energy for transducer 24 is conventional technology and, is, therefore, not illustrated herein.

Rotation of axle 30 (as indicated by arrow 31) causes rotor arm 12 to spin in a horizontal plane causing chamber 14 to pivot outwardly (FIG. 2) about pivot 16 so that fluid 20 is subjected to centrifugal forces parallel to the plane of rotation. The orientation of chamber 14 during centrifugation is best seen in the partial schematic and cross sectional view illustrated FIG. 2. In particular, chamber 14 and vessel 20 are oriented horizontally with the centrifugal forces exerted thereon being illustrated schematically at 34.

During centrifugation, standing waves (as represented schematically at arrows 40 and 41) are created in liquid 22 by the introduction of electrical energy into transducer 24. Standing waves 40 and 41 cause agglomeration of particles 32 in fluid 22 resulting in a rapid displacement of the particles (as illustrated by sedimentation arrow 33) in a direction generally parallel to the direction of centrifugal force 34. Transducer 24 is acoustically coupled into fluid 22 in vessel 20 through coupling fluid 25. The opposite face of vessel 14, face 15, serves as the reflector which helps create standing waves 40 and 41 in fluid 22 by cooperating with transducer 24.

Movement of agglomerated particles 32 as represented by sedimentation arrow 33 creates an accumulation of sedimented particles 32*a* in the bottom of vessel 20. This sedimentation of particles 32*a* displaces supernatant fluid causing a countercurrent flow of supernatant fluid as shown by arrow 35. Importantly, the standing waves 40 and 41 as shown by agglomerated particles 32 provide relatively open channels for supernatant fluid to flow as shown by countercurrent flow 35. This feature contributes significantly to the rate of sedimentation agglomerated of particles 32 since the supernatant fluid is unimpeded in its flow and does not have to work its way through particles traveling in the opposite direction. It should be noted that transducer 24 does not extend to the bottom vessel 20 to keep standing waves 40 and 41 created thereby from disturbing sedimentation of particles 32*a*. This region is shown by open space 24*a*.

The electrical circuit to operate transducer 24 is conventional and includes a wave function generator (not shown) and a corresponding amplifier (not shown) connected to RF supply coil 28. RF pickup coil 26 couples the electrical energy from the wave function generator across the rotating platform of rotor arm 12 thereby eliminating the need for slip rings, etc. Electrical energy picked up by RF pickup coil 26 passes into transducer 24 to create the necessary ultrasound energy which causes formation of standing waves 32 which create the agglomerated particles as described hereinbefore.

Figure 3:
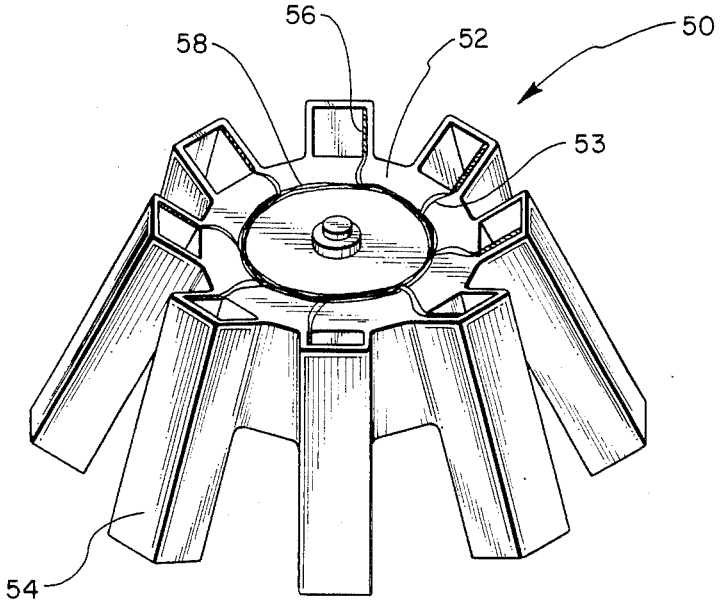
FIG. 3 is a perspective view of a centrifuge head having receptacles at a fixed angle to the axis of rotation.

Referring now to FIG. 3, a second preferred embodiment of the centrifuge head is shown generally at 50 and includes a planar rotor arm 52 around the periphery of which are appended a plurality of chambers 54. Chambers 54 are mounted at a fixed angle to rotor arm 52 and each includes a transducer 56 mounted therein. An RF pickup coil 58 is mounted on the face of rotor arm 52 and is electrically connected to each of transducers 56 through leads 53.

Angled head centrifugation is known in the art and is embodied in various configurations. Advantages include smaller rotor diameter and increased sedimentation rates at given rotor speeds. In particular, agglomeration of particles is accelerated since the horizontal component of the centrifugal force drives the particles toward the walls of the vessel where they become agglomerated before moving under the vertical component of the centrifugal force toward the bottom of the vessel. The imposition of standing waves upon activation of transducers 56 will combine with the foregoing phenomenon to provide a significantly enhanced rate of sedimentation.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for enhanced separation through centrifugation comprising:

vessel means for containing a fluid, said fluid having particulates therein;

rotation means for rotating said vessel about an axis, said vessel being spaced from said axis, said rotation imposing a centrifugal force upon said particulates in said fluid; and agglomeration means for agglomerating said particulates comprising ultrasound means for imposing an ultrasound force upon said fluid undergoing said centrifugal force to create at least one standing wave in said fluid while imposing said centrifugal force upon said fluid, said standing wave being created generally orthogonal to said centrifugal force, said agglomeration means providing enhanced separation of said particulates during said centrifugation.

2. The apparatus defined in claim 1 wherein said vessel comprises coupling means for coupling said ultrasound force to said fluid.

3. The apparatus defined in claim 2 wherein said coupling means comprises an ultrasound coupling medium.

4. The apparatus defined in claim 1 wherein said rotation means comprises control means for controlling the speed and duration of said rotation means thereby regulating said centrifugal force imposed upon said fluid.

5. The apparatus defined in claim 1 wherein said ultrasound means comprises a transducer oriented to produce said ultrasound force upon said fluid generally transverse to the direction of said centrifugal force so as to produce standing waves in raid fluid, said standing waves being generally orthogonal with said centrifugal force.

6. An apparatus for ultrasound enhancement of sedimentation of particulates in a fluid during centrifugation of said fluid comprising:

centrifugation means for imposing a centrifugal force upon a volume of said fluid including a vessel for containment of said fluid and rotation means for rotating said vessel about an axis to create said centrifugal force; and ultrasound means for creating a standing wave inside said fluid during said centrifugation, said standing wave agglomerating said particulates, said ultrasound means including an ultrasound transducer, an ultrasound reflector, and coupling means for coupling ultrasound energy from said ultrasound transducer and said ultrasound reflector into said fluid.

7. The apparatus defined in claim 6 wherein said ultrasound means comprises a transducer oriented to produce said ultrasound force upon said fluid generally transverse to the direction of said centrifugal force so as to produce standing waves in said fluid, said standing waves being generally orthogonal with said centrifugal force.

8. A method for enhancing the centrifugation of a fluid comprising:

placing said fluid in a centrifugation vessel;

subjecting said fluid to a centrifugal force;

imposing an ultrasound force across said fluid in a direction transverse to said centrifugal force cause standing waves in said fluid, the plane of said standing waves being parallel to the direction of said centrifugal force.

* * * * *